United States Patent [19]

Newman et al.

[11] Patent Number: 4,631,758

[45] Date of Patent: Dec. 30, 1986

[54] PROTECTIVE HEADGEAR

[75] Inventors: Malcolm Newman, Huntington; Carl J. Abraham, Great Neck, both of N.Y.

[73] Assignee: Athletic Safety Products, Inc., Mineola, N.Y.

[21] Appl. No.: 850,587

[22] Filed: Apr. 11, 1986

[51] Int. Cl.[4] ..... A42B 1/08; A41D 13/00

[52] U.S. Cl. ..... 2/424; 2/9

[58] Field of Search ..... 2/9, 424, 425

[56] References Cited

U.S. PATENT DOCUMENTS

| | | | |
|---|---|---|---|
| 2,944,263 | 7/1960 | Rayburn et al. | 2/9 |
| 3,113,318 | 12/1963 | Marietta | 2/9 |
| 3,319,261 | 5/1967 | Dunning | 2/9 |
| 3,751,728 | 8/1973 | Thompkins | 2/425 X |
| 3,854,146 | 12/1974 | Dunning | 2/9 |
| 4,233,687 | 11/1980 | Lancellotti | 2/424 X |
| 4,271,537 | 6/1981 | Bowlus et al. | 2/424 |
| 4,342,122 | 8/1982 | Abraham et al. | 2/424 |
| 4,363,140 | 12/1982 | Correale | 2/424 X |
| 4,370,759 | 2/1983 | Zide | 2/424 |

*Primary Examiner*—Louis K. Rimrodt

*Attorney, Agent, or Firm*—Alan H. Levine

[57] ABSTRACT

A protective headgear comprising a helmet and a face mask of flexible material secured to the helmet. When a force capable of causing injury to the headgear wearer is applied to the face mask, the mask deflects to a significant degree, without fracturing, with respect to the helmet. The deflection may take place entirely within the material of the face mask, or the deflection may in part take place within the attachments resiliently securing the face mask to the helmet. The intersecting bars forming the face mask have modified trapezoidal cross-sectional shapes in which each base of the trapezoid is a circular arc tangent to the sides of the trapezoid.

4 Claims, 4 Drawing Figures

PROTECTIVE HEADGEAR

Figure 1:
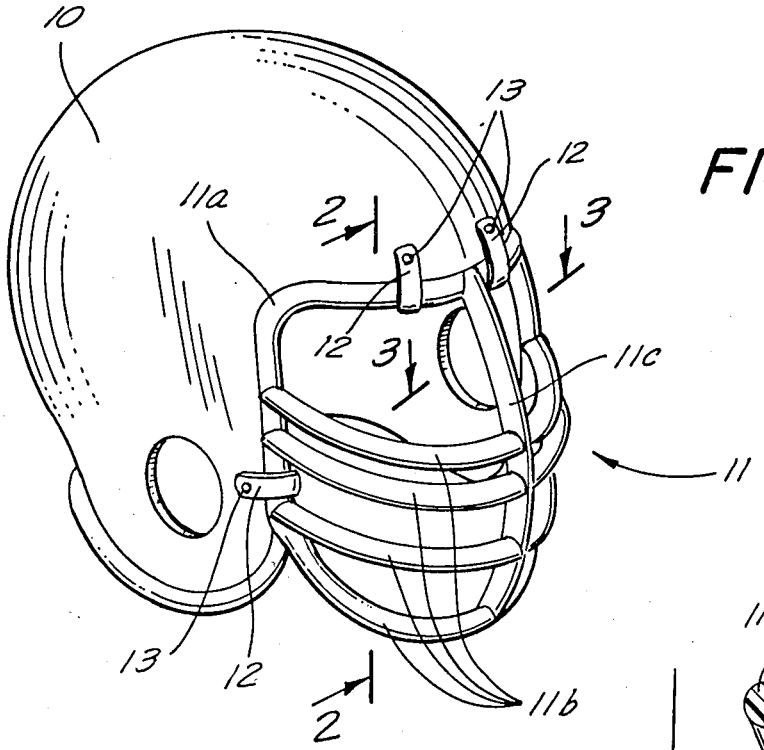

This invention relates to protective headgear, and more particularly to a combination helmet and face mask such as is commonly worn by participants in certain types of sporting events.

While the invention finds its primary utility with respect to football helmets and face masks, it is to be understood that it is applicable to any sport or activity in which such protection for participants is considered desirable.

Football helmets, originally of leather, have been used for almost 100 years to provide protection against head injury. Soon after the introduction of hard plastic helmets around 1950, face masks were added to the helmets to guard against injuries to the nose, teeth, and other parts of the face. Ironically, while face masks have served successfully to minimize injuries to the face, they may, in certain instances, have been responsible for increasing the severity of injuries to the neck and spine of those who wear them.

Typically, face masks are made of a rigid, i.e., relatively inflexible, material, either a metal or a hard plastic which simulates the rigidity of metal, presumably on the theory that the mask must be rigid to perform its protective function. Furthermore, in most cases, the rigid mask is rigidly attached to the helmet, although it has been suggested that the mask be separable from the helmet upon receiving an impact exceeding some predetermined force, and it has also been suggested that the face mask be resiliently secured to the helmet.

Because the helmet and face mask are in most cases a rigid system held tightly on the head, most of the force of a blow received by the face mask is transmitted through the helmet to the head of the wearer. As a result, a force of sufficient magnitude can and does cause serious neck and spine injury. More specifically, a blow to the mask directed full face or upwardly can product injury of the whiplash variety, while a sideward blow to the mask can cause a quick injury engendering rotation of the neck.

These problems can be minimized by the helmet and face mask combination, illustrated and desribed in our U.S. Pat. No. 4,342,122, capable of absorbing the major portion of a blow to the face mask, so that only a minor portion of the force of the blow is transmitted to the neck of the wearer. The face mask of that patent is made of a flexible material which deforms to absorb the force of the blow applied to it.

While the helmet and face mask combination of U.S. Pat. No. 4,342,122 serves admirably in performing its intended function, it has been found that its performance is enhanced when the bars of which the face mask is formed are of non-circular cross-section, and specifically when the bars have a modified trapezoidal cross-sectional shape wherein each base of the trapezoid is a circular arc tangent to both sides of the trapezoid.

It is, therefore, an object of the present invention to provide a helmet and face mask combination wherein the face mask is made of flexible material, and the bars defining the face mask have a modified cross-sectional shape as described above.

It is another object of the invention to provide such a helmet and face mask combination wherein the major axis of the modified trapezoidal cross-sectional shape of each of the mask bars extends in a direction toward and away from the plane of the face of the wearer, to maximize energy absorption, and the minor axis extends generally parallel or at an acute angle to the plane of the face of the wearer, to minimize any interference the face mask causes to the vision of the wearer.

Figure 3:
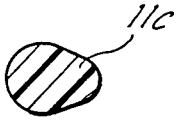
Figure 2:
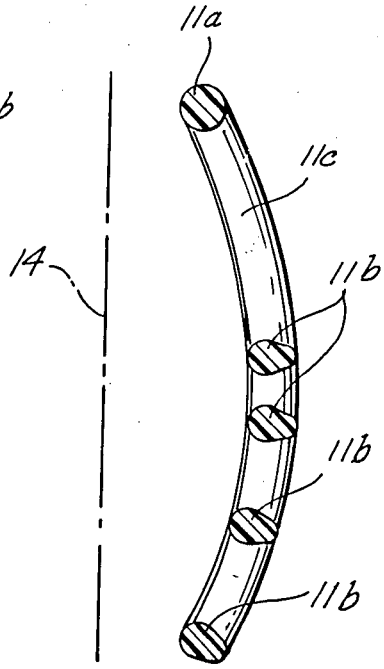
Figure 4:
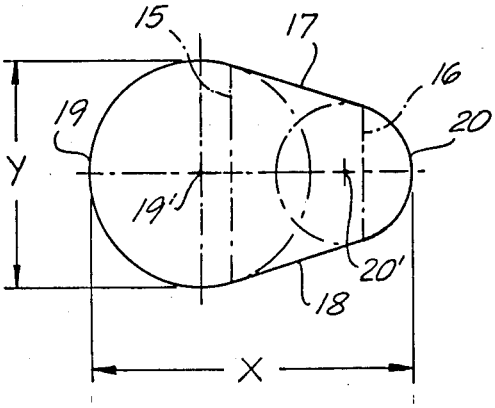

Additional objects and features of the invention will be apparent from the following description in which reference is made to the accompanying drawings. In the drawings:

FIG. 1 is a perspective view of a combination football helmet and face mask according to the present invention;

FIGS. 2 and 3 are vertical and horizontal cross-sectional views taken along lines 2—2 and 3—3, respectively, of FIG. 1; and FIG. 4 illustrates, on an enlarged scale, the cross-sectional shape of a typical face mask bar.

In the illustrative embodiment of the invention shown in the drawings, the helmet 10 may be entirely conventional, and formed of rigid plastic. The face mask 11 comprises a generally inverted U-shaped bar **11*a*, four curved horizontal bars 11*b*, and a curved vertical bar 11*c*, all firmly inter-connected at their points of intersection. In this embodiment, face mask 11 is rigidly secured to helmet 10 by four looped straps 12 (only three being shown), riveted at 13 to the helmet, through which portion 11*a*** of the face mask passes.

The face mask 11 is made of a flexible material which deforms when struck by a blow having a force which is within the range of magnitudes encountered during the play of a football game. The face mask must be flexible enough to deform and hence absorb the energy of a blow, and yet not be so flexible that it fails to protect the face of the wearer.

Inverted U-shaped bar **11*a*, which rests against helmet 10, may have a circular cross-sectional shape, as shown in FIG. 2. However, according to the present invention, each of bars 11*b* and 11*c*, projecting forwardly from helmet 10, has a non-circular, modified trapezoidal cross-sectional shape (see FIGS. 2 and 3). The term "modified trapezoidal" is meant to encompass a trapezoid wherein the usual straight and parallel bases of a trapezoid are replaced by circular arcs tangent to the sides of the trapezoid (see FIG. 4). Thus, a true trapezoid includes two straight bases 15 and 16 connected at their ends by converging sides 17 and 18. In a modified trapezoid, as that term is used herein, base 15 is replaced by a circular arc 19 tangent to both sides 17 and 18, and base 16 is replaced by a circular arc 20, having a radius smaller than that of arc 19, arc 20 also being tangent to both sides 17 and 18. Preferably, the complete circles of which arcs 19 and 20 forms parts overlap each other, as shown in FIG. 4. The major axis x of the modified trapezoidal shape is that axis which contains the centers 19' and 20' of the arcs 19 and 20. The minor axis y of the modified trapezoidal shape is perpendicular to the major axis and extends through the center 19' of arc 19**, i.e., through about the thickest part of the bar.

Each bar **11*b* and 11*c* is oriented so that the major axis of its cross-sectional shape extends transverse to the plane 14 of the face of the wearer of the helmet, and the minor axis of its cross-sectional shape extends generally parallel to plane 14, or as in the case of the lowermost bar 11*b*, at an acute angle to plane 14**.

The advantage of using face mask bars of non-circular cross-section is that such bars absorb more energy and experience less stress than comparable bars of circular cross-section. Since the ratio of major axis length X to minor axis length Y (FIG. 4) is greater than one, several times as much energy will be absorbed by a bar of modified trapezoidal shape as compared to a circular bar for the same degree of deformation of both bars. Looked at another way, for the same amount of energy absorption, the modified trapezoidal bar deflects to a lesser degree than does a circular base, i.e., a bar of modified trapezoidal cross-section will deflect only a fraction of the amount of deflection of a circular cross-section bar where both bars absorb the same amount of energy of a blow. Furthermore, the stresses on a modified trapezoidal cross-section bar are less than the stresses on a circular cross-section bar, for the same amount of energy absorption. In all of the examples given above, it is assumed that the diameter of the circular bar equals the length of the minor axis of the modified trapezoidal bar.

While even a small amount of non-circular elongation of the cross-sectional shape of the face mask bars gives some beneficial result, it has been found as a practical matter that the ratio of major axis length X to minor axis length Y should be at least 1.1 to yield a useful improvement in performance. Furthermore, there is no practical limit to how large this ratio can be, except perhaps as dictated by esthetic design considerations. In one desirable configuration, the radius of arc 19 is 0.1875 inch, the radius of arc 20 is 0.14 inch, and the ratio of major axis length X to minor axis length Y is 1.67.

It will be appreciated that a face mask according to this invention, made of flexible bars of modified trapezoidal cross-section, has a superior ability to absorb shock and hence to reduce injury. Such a mask also experiences less stress, and hence will will have a longer useful life. Equivalent performance could be achieved by using circular cross-section bars of larger diameter. However, as the diameter of the face mask bars is increased, the ability of the wearer to see through the mask is reduced. An advantage of the present invention is that the cross-sections of the face mask bars are elongated in a direction parallel to the line of sight of the wearer so that interference with the vision of the wearer is minimized. Furthermore, because the sides 17 and 18 of each bar converge in a direction away from the wearer's face, visibility is enhanced, as compared to bars of circular or even elliptical cross-sectional shape.

The face mask of this invention is formed of a material which permits it to flex at least several inches without fracture. In contrast, the rigid face masks conventionally employed will fracture well before they flex even one or two inches.

The face mask of this invention may be formed of an elastomeric material, such as polyurethane or silicone. However, suitable thermoplastic or even thermosetting materials can be used as well. Furthermore, although bars 11*a*, 11*b*, and 11*c* of which the face mask is constructed are illustrated in FIGS. 2 and 3 as being solid, they may also be formed of hollow tubular material.

The drawings illustrate a rigid securement between the face mask 11 and helmet 10. Alternatively, the face mask may be resiliently mounted on the helmet. An example of such a mounting is shown in U.S. Pat. No. 3,854,146. Should a resilient mounting be employed, the deflection described above of the face mask with respect to the helmet takes place partially in the material of the face mask and partially in the resilient mounting between the mask and helmet.

On occasion, a conventional face mask made of metal or hard plastic breaks, leaving jagged edges which can cause injury. A flexible face mask according to this invention, is much less likely to break; however, should a break occur, the edges will be smoother and softer than those of a broken rigid mask, and hence far less likely to cause injury.

The invention has been shown and described in preferred form only, and by way of example, and many variations may be made in the invention which will still be comprised within its spirit.

It is understood, therefore, that the invention is not limited to any specific form or embodiment except insofar as such limitations are included in the appended claims.

We claim:

1. A protective headgear comprising:

(a) a helmet, (b) a face mask, and (c) means securing the face mask to the helmet, (d) the face mask being formed of at least one bar of flexible material, the bar having a modified trapezoidal cross-sectional shape, each base of the trapezoid being a circular arc tangent to the sides of the trapezoid.

2. A protective headgear as defined in claim 1, wherein the face mask if formed of a plurality of interconnected bars of flexible material, each of the bars having a modified trapezoidal cross-sectional shape, each base of each trapezoid being a circular arc tangent to the sides of the trapezoid.

3. A protective headgear as defined in claim 1 wherein the major axis of the trapezoidal cross-sectional shape includes the centers of the arcs and extends transverse to the plane of the face of the wearer of the headgear, and the minor axis of the trapezoidal cross-sectional shape is perpendicular to the major axis and extends generally parallel, or at an acute angle, to the plane of the face of the wearer.

4. A protective headgear as defined in claim 3 wherein the sides of the trapezoidal cross-sectional shape converge in a direction away from the face of the wearer.

* * * * *